US011069278B2

(12) United States Patent
Kim et al.

(10) Patent No.: US 11,069,278 B2
(45) Date of Patent: Jul. 20, 2021

(54) GAMMA REFERENCE VOLTAGE OUTPUT CIRCUIT OF DISPLAY DEVICE

(71) Applicant: SILICON WORKS CO., LTD., Daejeon (KR)

(72) Inventors: Kyoung Tae Kim, Daejeon (KR); Jun Sik Woo, Daejeon (KR)

(73) Assignee: SILICON WORKS CO., LTD., Daejeon (KR)

( * ) Notice: Subject to any disclaimer, the term of this patent is extended or adjusted under 35 U.S.C. 154(b) by 0 days.

(21) Appl. No.: 17/124,923

(22) Filed: Dec. 17, 2020

(65) Prior Publication Data

US 2021/0193009 A1 Jun. 24, 2021

(30) Foreign Application Priority Data

Dec. 20, 2019 (KR) ..... 10-2019-0171770

(51) Int. Cl.
*G09G 3/20* (2006.01)

(52) U.S. Cl.
CPC ..... *G09G 3/20* (2013.01); *G09G 2310/027* (2013.01); *G09G 2310/0291* (2013.01); *G09G 2320/0276* (2013.01)

(58) Field of Classification Search
CPC ..... G09G 3/20; G09G 2310/027; G09G 2310/0291; G09G 2320/0276
See application file for complete search history.

(56) References Cited

U.S. PATENT DOCUMENTS

| | | | | |
|---|---|---|---|---|
| 8,094,107 | B2 | 1/2012 | Nishimura et al. | |
| 8,223,099 | B2 | 7/2012 | Nishimura et al. | |
| 2007/0182683 | A1 | 8/2007 | Chin et al. | |
| 2007/0247408 | A1 | 10/2007 | Nishimura et al. | |
| 2007/0247409 | A1 | 10/2007 | Nishimura et al. | |
| 2015/0145898 | A1* | 5/2015 | Hwang | G09G 3/3614 345/690 |
| 2015/0348492 | A1* | 12/2015 | Park | G09G 3/3677 345/205 |
| 2016/0247451 | A1* | 8/2016 | Kim | G09G 3/3233 |
| 2017/0076656 | A1* | 3/2017 | Bang | G09G 3/2092 |
| 2017/0098404 | A1* | 4/2017 | Lee | G09G 3/20 |
| 2017/0309219 | A1* | 10/2017 | Kong | G09G 3/2003 |
| 2018/0268780 | A1* | 9/2018 | Bae | G09G 5/008 |
| 2019/0035342 | A1* | 1/2019 | Ito | G09G 3/3611 |

FOREIGN PATENT DOCUMENTS

| | | | |
|---|---|---|---|
| JP | 2007-213028 | A | 8/2007 |
| JP | 4915841 | B2 | 4/2012 |
| JP | 5137321 | B2 | 2/2013 |

* cited by examiner

*Primary Examiner* — Andrew Sasinowski
(74) *Attorney, Agent, or Firm* — Fenwick & West LLP

(57) ABSTRACT

The present embodiment relates to a gamma reference voltage output circuit of a display device, and more particularly, to a gamma reference voltage output circuit having a structure for sharing an element required for outputting a gamma reference voltage in the gamma reference voltage output circuit included in each of a plurality of driving chips.

15 Claims, 5 Drawing Sheets

GAMMA REFERENCE VOLTAGE OUTPUT CIRCUIT OF DISPLAY DEVICE

CROSS REFERENCE TO RELATED APPLICATION

This application claims priority from Republic of Korea Patent Application No. 10-2019-0171770, filed on Dec. 20, 2019, which is hereby incorporated by reference in its entirety.

BACKGROUND

1. Field of Technology

The present embodiment relates to a gamma reference voltage output circuit of a display device.

2. Description of the Prior Art

In line with the development of the information society, there is increasing demand for products that require display devices. Recently, various types of display devices, such as liquid crystal display devices, plasma display devices, organic light-emitting diode display devices, and the like, have been used.

Since the display device is thin and light, it is easy to miniaturize the same, and the display device has a low driving voltage and power consumption and is able to implement picture quality close to that of a cathode ray tube. Therefore, small- and medium-sized display devices such as mobile communication terminals, monitors, notebook computers, and the like are currently widely used.

Here, in the small- and medium-sized display devices, a driving device for driving a display panel is configured as a chip and is mounted to the display panel. Recently, increases in the size and resolution of the display panel have resulted in an increasing number of display panels to which a plurality of driving chips is mounted.

The display panel to which a plurality of driving chips is mounted as described above has a problem in that display quality may be degraded depending on a deviation in output between driving chips.

SUMMARY

An aspect of the present embodiment is to provide a technique for eliminating a deviation in output between driving chips in a display panel to which a plurality of driving chips is mounted.

In view of the foregoing, an embodiment provides a gamma reference voltage output circuit of a display device, which includes: a first gamma reference voltage output circuit including a one-sided gamma buffer circuit configured to receive M (M is a natural number) one-sided division voltages and to output M one-sided buffering voltages, and a one-sided gamma reference voltage generating circuit configured to generate a second one-sided gamma reference voltage to an $(N-1)^{th}$ (N is a natural number greater than M) one-sided gamma reference voltage using the M one-sided buffering voltages and the first one-sided gamma reference voltage; a buffering voltage relay circuit having one end connected to the output side of the one-sided gamma buffer circuit and configured to transmit the M one-sided buffering voltages to the opposite end thereof; and a second gamma reference voltage output circuit including an opposite-sided gamma reference voltage generating circuit connected to the opposite end of the buffering voltage relay circuit and configured to receive the M one-sided buffering voltages and to generate a second opposite-sided gamma reference voltage to an $(N-1)^{th}$ opposite-sided gamma reference voltage using the M one-sided buffering voltages and a first opposite-sided gamma reference voltage.

The first gamma reference voltage output circuit may further include a one-sided power input circuit configured to output the first one-sided gamma reference voltage, the $N^{th}$ one-sided gamma reference voltage, and the M one-sided division voltages, and the second gamma reference voltage output circuit may further include an opposite-sided power input circuit configured to output a first opposite-sided gamma reference voltage corresponding to the first one-sided gamma reference voltage and an $N^{th}$ opposite-sided gamma reference voltage corresponding to the $N^{th}$ one-sided gamma reference voltage in the state of being electrically isolated from the one-sided power input circuit.

The one-sided power input circuit may include: a first one-sided input buffer configured to receive a first input voltage and to output the first one-sided gamma reference voltage; a first one-sided line having one end connected to an output end of the first one-sided input buffer; a second one-sided input buffer configured to receive a second input voltage and to output the $N^{th}$ one-sided gamma reference voltage; a second one-sided line having one end connected to an output end of the second one-sided input buffer; and a first one-sided resistor array configured to receive the first one-sided gamma reference voltage from the first one-sided line and to generate the M one-sided division voltages.

The opposite-sided power input circuit may include: a first opposite-sided input buffer configured to receive a third input voltage and to output the first opposite-sided gamma reference voltage; a first opposite-sided line having one end connected to an output end of the first opposite-sided input buffer; a second opposite-sided input buffer configured to receive a fourth input voltage and to output the $N^{th}$ opposite-sided gamma reference voltage; and a second opposite-sided line having one end connected to an output end of the second opposite-sided input buffer.

The opposite end of the first one-sided line and the opposite end of the first opposite-sided line may be electrically isolated from each other, and the opposite end of the second one-sided line and the opposite end of the second opposite-sided line may also be electrically isolated from each other.

The first input voltage and the third input voltage may be adjusted such that the first opposite-sided gamma reference voltage and the first one-sided gamma reference voltage match each other, and the second input voltage and the fourth input voltage may be adjusted such that the $N^{th}$ opposite-sided gamma reference voltage and the $N^{th}$ one-sided gamma reference voltage match each other.

Another embodiment provides a gamma reference voltage output circuit of a display device, which includes: a first gamma reference voltage output circuit including a one-sided gamma buffer circuit configured to receive M (M is a natural number) one-sided division voltages, to buffer the M one-sided division voltages, and to output M one-sided buffering voltages and a one-sided gamma reference voltage generating circuit configured to generate a second one-sided gamma reference voltage to an $(N-1)^{th}$ (N is a natural number greater than M) one-sided gamma reference voltage using the M one-sided buffering voltages and the first one-sided gamma reference voltage; a division voltage relay circuit having one end connected to an input side of the one-sided gamma buffer circuit and configured to transmit the M one-sided division voltages to the opposite end thereof; and a second gamma reference voltage output circuit including an opposite-sided gamma buffer circuit having an input side connected to the opposite end of the division voltage relay circuit and configured to receive the M one-sided division voltages, to buffer the M one-sided division voltages, and to output M opposite-sided buffering voltages and an opposite-sided gamma reference voltage generating circuit configured to generate a second opposite-sided gamma reference voltage to an $(N-1)^{th}$ opposite-sided gamma reference voltage using the M opposite-sided buffering voltages and the first opposite-sided gamma reference voltage.

The first gamma reference voltage output circuit may further include a one-sided power input circuit configured to output the first one-sided gamma reference voltage, the $N^{th}$ one-sided gamma reference voltage, and the M one-sided division voltages, and the second gamma reference voltage output circuit may further include an opposite-sided power input circuit configured to output a first opposite-sided gamma reference voltage corresponding to the first one-sided gamma reference voltage and an $N^{th}$ opposite-sided gamma reference voltage corresponding to the $N^{th}$ one-sided gamma reference voltage in the state of being electrically isolated from the one-sided power input circuit.

The gamma reference voltage output circuit may further include a buffering voltage relay circuit having one end connected to an output side of the one-sided gamma buffer circuit and the opposite end connected to the opposite-sided gamma reference voltage generating circuit and configured to transmit the M one-sided buffering voltages to the opposite-sided gamma reference voltage generating circuit.

Each of the division voltage relay circuit and the buffering voltage relay circuit may include a switch, and if any one of the switch of the division voltage relay circuit and the switch of the buffering voltage relay circuit is turned on, the remaining one thereof is maintained to be turned off.

If the switch of the division voltage relay circuit is turned on and if the switch of the buffering voltage relay circuit is turned off, the opposite-sided gamma buffer circuit may receive the M one-sided division voltages from the division voltage relay circuit, and may output them as the M opposite-sided buffering voltages, and the opposite-sided gamma reference voltage generating circuit may generate the second opposite-sided gamma reference voltage to the $(N-1)^{th}$ opposite-sided gamma reference voltage using the M opposite-sided buffering voltages and the first opposite-sided gamma reference voltage.

If the switch of the buffering voltage relay circuit is turned on and if the switch of the division voltage relay circuit is turned off, the opposite-sided gamma reference voltage generating circuit may receive the M one-sided buffering voltages from the buffering voltage relay circuit, and may generate the second opposite-sided gamma reference voltage to the $(N-1)^{th}$ opposite-sided gamma reference voltage using the M one-sided buffering voltages and the first opposite-sided gamma reference voltage.

Another embodiment provides a gamma reference voltage output circuit of a display device including: a first gamma reference voltage output circuit including a one-sided power input circuit configured to output a first one-sided reference voltage and M+2 (M is a natural number) one-sided division voltages, a one-sided gamma buffer circuit configured to receive the M+2 one-sided division voltages and to output M+2 one-sided buffering voltages, and a one-sided gamma reference voltage generating circuit configured to generate a first one-sided gamma reference voltage to an $N^{th}$ (N is a natural number greater than M) one-sided gamma reference voltage using the M+2 one-sided buffering voltage and the first one-sided reference voltage; a one-sided voltage relay circuit having one end connected respectively to an output side of the one-sided power input circuit and to an output side of the one-sided gamma buffer circuit, and configured to transmit the first one-sided reference voltage and the M+2 one-sided buffering voltages to the opposite end thereof; and a second gamma reference voltage output circuit including an opposite-sided gamma reference voltage generating circuit connected to the opposite end of the one-sided voltage relay circuit and configured to receive the first one-sided reference voltage and the M+2 one-sided buffering voltages and to generate a first opposite-sided gamma reference voltage to an $N^{th}$ opposite-sided gamma reference voltage using the M+2 one-sided buffering voltages and the first one-sided reference voltage.

The one-sided power input circuit may include: a first one-sided input buffer configured to receive a first voltage and to output the first one-sided reference voltage; a first one-sided line having one end connected to an output end of the first one-sided input buffer; and a first one-sided resistor array configured to receive the first one-sided reference voltage from the first one-sided line and to generate the M+2 one-sided division voltages.

The one-sided gamma buffer circuit may include M+2 one-sided gamma buffers, and the one-sided voltage relay circuit may include: M+3 one-sided inner lines having one ends connected respectively to the first one-sided line and to output ends of the M+2 one-sided gamma buffers, and the opposite ends at which one-sided connection pads are provided; M+3 opposite-sided inner lines having one ends connected to input sides of the opposite-sided gamma reference voltage generating circuit and the opposite ends at which opposite-sided connection pads are provided; and M+3 connection lines having one end connected to each of the M+3 one-sided connection pads and the opposite end connected to each of the M+3 opposite-sided connection pads.

As described above, according to the present embodiment, it is possible to eliminate a deviation in the gamma reference voltage between driving chips, which causes a deviation in output between the driving chips, thereby improving the display quality of a display panel.

BRIEF DESCRIPTION OF THE DRAWINGS

The above and other aspects, features, and advantages of the present disclosure will be more apparent from the following detailed description taken in conjunction with the accompanying drawings, in which.

DETAILED DESCRIPTION

Figure 1:
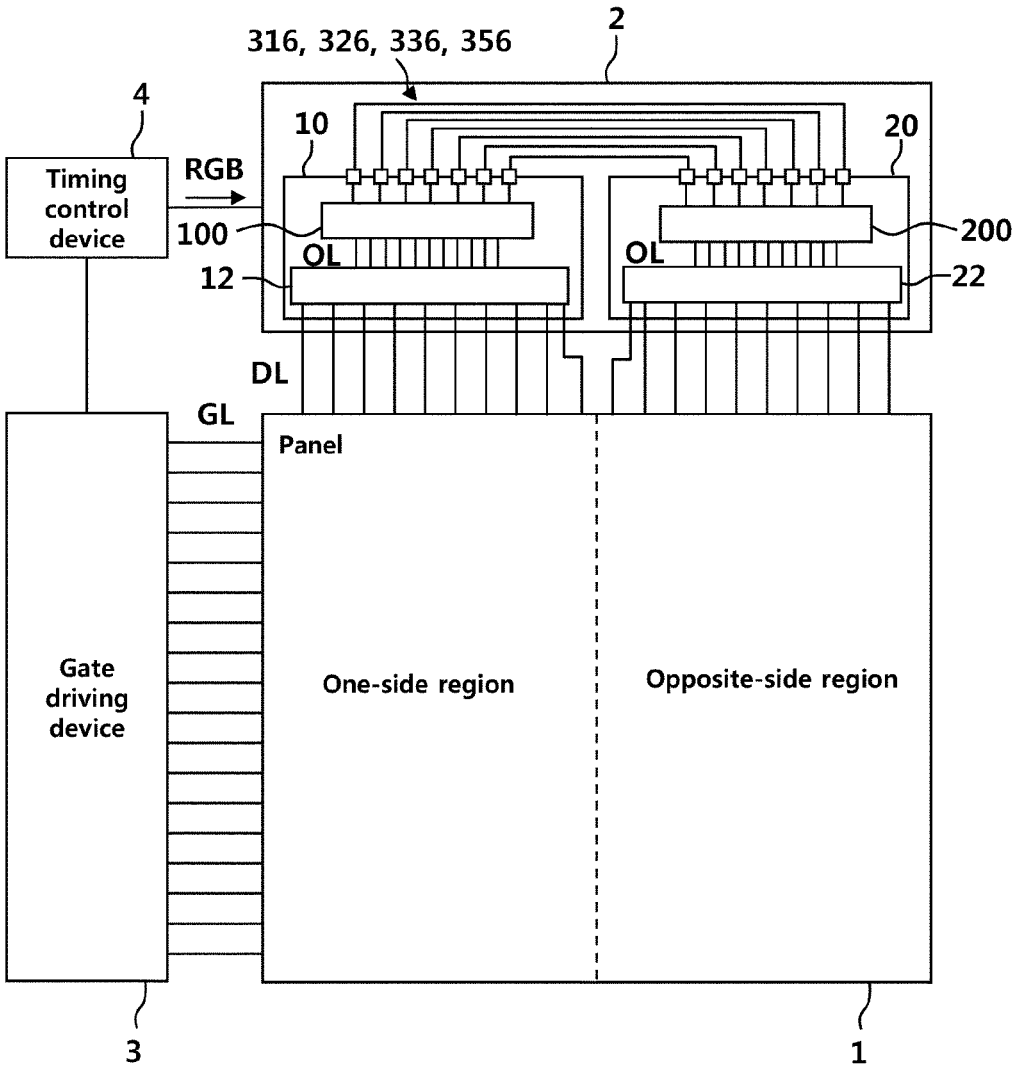
FIG. 1 is a block diagram of a display device according to an embodiment.

FIG. 1 is a block diagram of a display device according to an embodiment.

Referring to FIG. 1, the display device may include a panel 1, a data driving device 2, a gate driving device 3, a timing control device 4, and the like.

The panel 1 may have a plurality of data lines DL and a plurality of gate lines GL arranged thereon, and may have a plurality of subpixels in a matrix form. The respective subpixels may be connected to the data lines DL according to scan signals supplied to the gate lines GL. In addition, the brightness of each subpixel may be adjusted according to a data voltage supplied to the data line DL.

The panel 1 may be a LCD (liquid crystal display) panel, an OLED (organic light-emitting diode) panel, or another type of panel. In the case where the panel 1 is an OLED panel, OLEDs may be disposed in the respective subpixels, and a plurality of transistors connected to the OLEDs may be disposed. The gate line GL and the data line DL may be connected to a transistor disposed in each subpixel. If a scan signal indicating turn-on is supplied to the gate line GL, one of the plurality of transistors may be turned on, and the data line DL may be connected to the gate of another transistor. In addition, the magnitude of current flowing through the other transistor may be adjusted depending on the magnitude of the data voltage supplied to the data line DL, thereby adjusting the brightness of the OLED.

The gate driving device 3 may supply scan signals to the gate lines GL, and the data driving device 2 may supply data voltages to the data lines DL. The gate driving device 3 and the data driving device 2 may receive a control signal or a synchronization signal from the timing control device 4, and may determine driving timing for each subpixel according to the control signal or synchronization signal.

The timing control device 4 may transmit image data RGB indicating the grayscale value of each subpixel to the data driving device 2. The timing control device 4 may receive image data RGB from an external device, may convert the image data RGB to a form conforming to the data driving device 2, and may transmit the same. In the case where the panel 1 is an OLED panel, the timing control device 4 may detect changes in the characteristics of each subpixel of the OLED panel, may convert the image data RGB to compensate for the characteristic changes, and may then transmit the same to the data driving device 2.

The data driving device 2 may extract pixel image data for each subpixel from the image data RGB, may generate a data voltage according to the pixel image data, and may supply the generated data voltage to the data line (DL) connected to each subpixel.

If the panel is larger than a specific size, the data driving device 2 may include two or more driving chips. For example, the data driving device 2 may include a first driving chip 10 for supplying a data voltage to one-side region of the panel (1) and a second driving chip 20 for supplying a data voltage to an opposite-side region of the panel (1).

In the case where the data driving device 2 includes a first driving chip 10 and a second driving chip 20, each of the first driving chip 10 and the second driving chip 20 may include a channel circuit and a gamma reference voltage output circuit.

In other words, the first driving chip 10 may include a first channel circuit 12 and a first gamma reference voltage output circuit 100, and the second driving chip 20 may include a second channel circuit 22 and a second gamma reference voltage output circuit 200. In addition, each of the first driving chip 10 and the second driving chip 20 may further include a data processing circuit (not shown) that receives image data from the timing control device 4 and extracts pixel image data (pRGB) from the image data.

Meanwhile, the first channel circuit 12 may include a plurality of channel circuits for outputting data voltages in one-side region, and the second channel circuit 22 may include a plurality of channel circuits for outputting data voltages in the opposite-side region.

Here, one channel circuit may include a shift register, a latch, a digital-to-analog converter (DAC), an output buffer, and the like.

Pixel image data (pRGB) extracted by the data processing circuit (not shown) may be temporarily stored in the latch (LT) by a shift register (SR), and may then be converted into an analog data voltage (Vdata) in the DAC. In addition, the data voltage (Vdata) may be output to the data lines by the output buffer (BF).

In an embodiment, the DAC may receive a plurality of gamma voltages from any one gamma reference voltage output circuit 100 or 200. Further, the DAC may generate a data voltage (Vdata) by selecting one of a plurality of gamma voltages according to pixel image data (pRGB).

The DAC may include a switch array. Here, the switch array may include a plurality of switches, and the plurality of switches may be connected to output lines OL of any one gamma reference voltage output circuit 100 or 200. The number of output lines OL may be the same as the number of gamma reference voltages output from any one gamma reference voltage output circuit 100 or 200. For example, if the gamma reference voltage includes a first gamma reference voltage to a $1024^{th}$ gamma reference voltage, the number of output lines OL may be 1024.

In this case, the switch array may receive a first gamma reference voltage to a $1024^{th}$ gamma reference voltage through the output lines OL, and may select any one of the first gamma reference voltage to the 1024th gamma reference voltage according to a previously input grayscale value of pixel image data (pRGB), thereby outputting a data voltage.

In one embodiment, the first gamma reference voltage output circuit 100 and the second gamma reference voltage output circuit 200 included in the first driving chip 10 and the second driving chip 20, respectively, may share elements necessary for outputting the gamma reference voltages, thereby eliminating the deviation in output between the gamma reference voltages.

A detailed description thereof is as follows.

Figure 2:
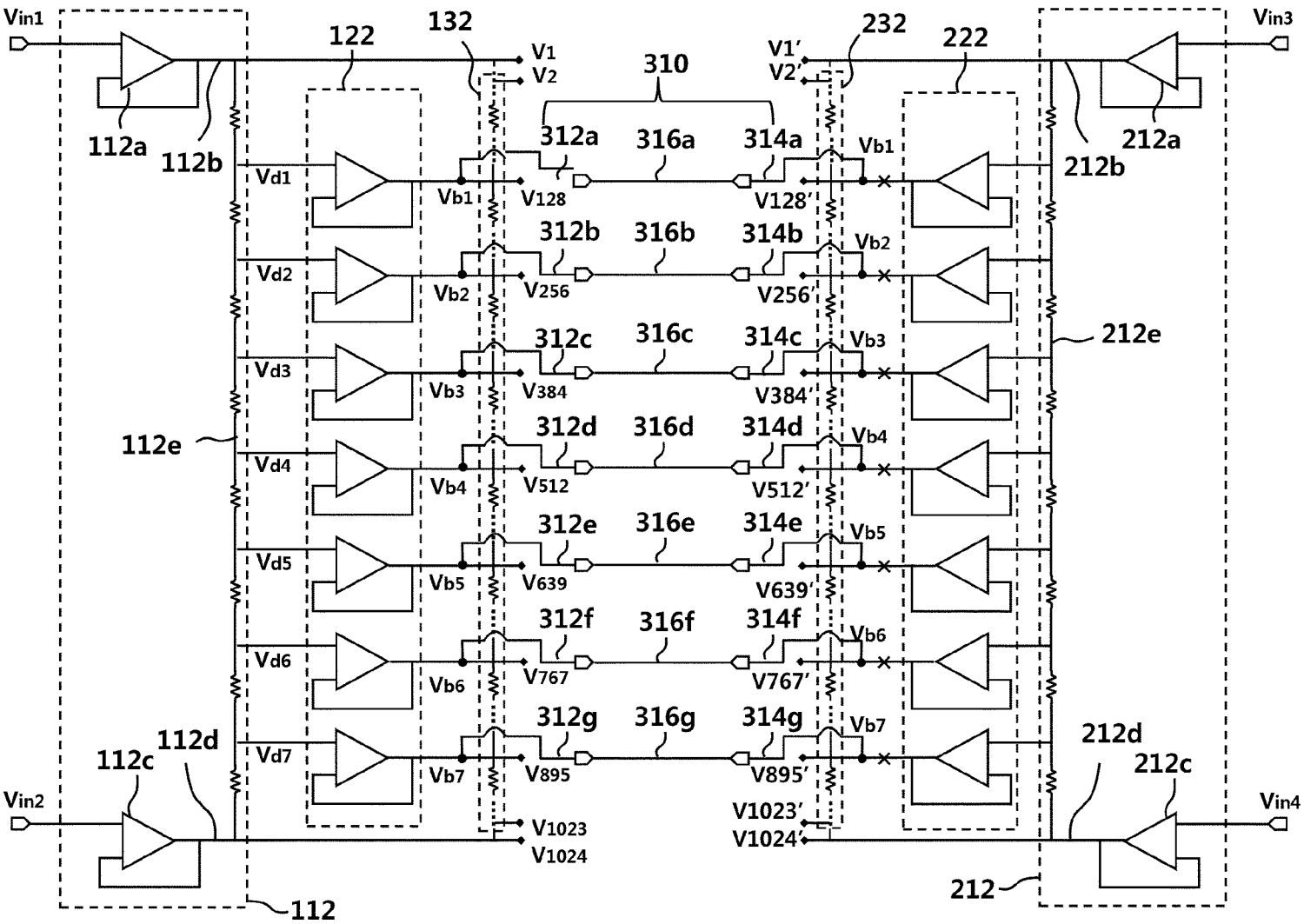
FIG. 2 is a block diagram of a gamma reference voltage output circuit according to a first embodiment.

FIG. 2 is a block diagram of a gamma reference voltage output circuit according to a first embodiment.

Referring to FIG. 2, a gamma reference voltage output circuit according to a first embodiment may include a first gamma reference voltage output circuit 100 included in the first driving chip 10, a second gamma reference voltage output circuit 200 included in the second driving chip 20, and a buffering voltage relay circuit 310 for electrically connecting the first gamma reference voltage output circuit 100 with the second gamma reference voltage output circuit 200.

In the first embodiment, the first gamma reference voltage output circuit 100 may include a one-sided power input circuit 112, a one-sided gamma buffer circuit 122, and a one-sided gamma reference voltage generating circuit 132.

The one-sided power input circuit 112 may output a first one-sided gamma reference voltage, an $N^{th}$ one-sided gamma reference voltage, and M one-sided division voltages.

The one-sided power input circuit 112 may include a first one-sided input buffer **112*a* for receiving a first input voltage Vin1 and outputting a first one-sided gamma reference voltage V1, a first one-sided line 112***b* having one end connected to the output end of the first one-sided input buffer 112*a*, a second one-sided input buffer 112*c* for receiving a second input voltage Vin2 and outputting an $N^{th}$ one-sided gamma reference voltage (e.g., V1024), a second one-sided line 112*d* connected to the output end of the second one-sided input buffer 112*c*, and a first one-sided resistor array 112*e* for receiving the first one-sided gamma reference voltage V1 from the first one-sided line 112*b* and generating M one-sided division voltages (e.g., Vd1 to Vd7).

In an embodiment, although a description will be made based on the case where the first one-sided resistor array 112*e* receives the first one-sided gamma reference voltage V1 for convenience of explanation, in the practical application of an embodiment, the first one-sided resistor array 112*e* may receive the $N^{th}$ one-sided gamma reference voltage (e.g., V1024) from the second one-sided line 112*d*, and may generate M one-sided division voltages.

One end of the first one-sided resistor array 112*e* may be connected to the first one-sided line 112*b*, and the opposite end thereof may be connected to the second one-sided line 112*d*. In addition, nodes may be formed in some of a plurality of resistors constituting the first one-sided resistor array 112*e*, and M one-sided division voltages may be output through the nodes. Here, the resistors constituting the first one-sided resistor array 112*e* may have substantially the same resistance value.

The one-sided gamma buffer circuit 122 may receive M one-sided division voltages generated by the first one-sided resistor array 112*e*, and may buffer the M one-sided division voltages, thereby outputting M one-sided buffering voltages. The one-sided gamma buffer circuit 122 may include M one-sided gamma buffers.

The one-sided gamma reference voltage generating circuit 132 may include a plurality of resistors connected to each other in series, and may separate the first one-sided gamma reference voltage from the M one-sided buffering voltages using the plurality of resistors, thereby generating a second one-sided gamma reference voltage to an $(N-1)^{th}$ one-sided gamma reference voltage. That is, the one-sided gamma reference voltage generating circuit 132 may generate a second one-sided gamma reference voltage to an $(N-1)^{th}$ one-sided gamma reference voltage using the first one-sided gamma reference voltage and the M one-sided buffering voltages.

Here, one end of the one-sided gamma reference voltage generating circuit 132 may be connected to the first one-sided line 112*b*, and the opposite end thereof may be connected to the second one-sided line 112*d*. In addition, the one-sided buffering voltages output from the one-sided gamma buffer circuit 122 may be input to nodes formed in some of the multiple resistors constituting the one-sided gamma reference voltage generating circuit 132.

The second one-sided gamma reference voltage to the $(N-1)^{th}$ one-sided gamma reference voltage generated by the one-sided gamma reference voltage generating circuit 132 and the first one-sided gamma reference voltage and the $N^{th}$ one-sided gamma reference voltage output from the one-sided power input circuit 112 may be supplied to a plurality of switch arrays included in the first channel circuit 12 through the output lines OR of the first gamma reference voltage output circuit 100.

The second gamma reference voltage output circuit 200 may include an opposite-sided power input circuit 212 and an opposite-sided gamma reference voltage generating circuit 232.

The opposite-sided power input circuit 212 may output a first opposite-sided gamma reference voltage and an $N^{th}$ opposite-sided gamma reference voltage in the state of being electrically isolated from the one-sided power input circuit 112. Here, the first opposite-sided gamma reference voltage may correspond to the first one-sided gamma reference voltage, and the $N^{th}$ opposite-sided gamma reference voltage may correspond to the $N^{th}$ one-sided gamma reference voltage. In other words, the value of the first opposite-sided gamma reference voltage may be the same as the value of the first one-sided gamma reference voltage, or the deviation therebetween may be very small. In addition, the value of the $N^{th}$ opposite-sided gamma reference voltage may also be the same as the value of the $N^{th}$ one-sided gamma reference voltage, or the deviation therebetween may be very small.

The opposite-sided power input circuit 212 may include a first opposite-sided input buffer 212*a* for receiving a third input voltage Vin3 and outputting a first opposite-sided gamma reference voltage V1', a first opposite-sided line 212*b* having one end connected to the output end of the first opposite-sided input buffer 212*a*, a second opposite-sided input buffer 212*c* for receiving a fourth input voltage Vin4 and outputting an $N^{th}$ opposite-sided gamma reference voltage (e.g., V1024'), and a second opposite-sided line 212*d* connected to the output end of the second opposite-sided input buffer 212*c*. Here, the opposite end of the first one-sided line 112*b* and the opposite end of the first opposite-sided line 212*b* may be electrically isolated from each other, and the opposite end of the second one-sided line 112*d* and the opposite end of the second opposite-sided line 212*d* may also be electrically isolated from each other.

Meanwhile, the opposite-sided power input circuit 212 may further include a first opposite-sided resistor array 212*e* including a plurality of resistors connected to each other in series.

The opposite-sided gamma reference voltage generating circuit 232 may include a number of resistors connected to each other in series, and may separate a first opposite-sided gamma reference voltage and M one-sided buffering voltages input through a buffering voltage relay circuit 310, which will be described later, using the resistors, thereby generating a second opposite-sided gamma reference voltage to an $(N-1)^{th}$ opposite-sided gamma reference voltage.

Here, one end of the opposite-sided gamma reference voltage generating circuit 232 may be connected to the first opposite-sided line 212*b*, and the opposite end thereof may be connected to the second opposite-sided line 212*d*.

In addition, the one-sided buffering voltages input through the buffering voltage relay circuit 310 may be input to nodes formed in some of the multiple resistors constituting the opposite-sided gamma reference voltage generating circuit 232.

The resistance value of each of the plurality of resistors constituting the opposite-sided gamma reference voltage generating circuit 232 may be the same as the resistance value of each of the plurality of resistors constituting the one-sided gamma reference voltage generating circuit 132.

The second opposite-sided gamma reference voltage to the $(N-1)^{th}$ opposite-sided gamma reference voltage generated by the opposite-sided gamma reference voltage generating circuit 232 and the first opposite-sided gamma reference voltage and the $N^{th}$ opposite-sided gamma reference voltage output from the opposite-sided power input circuit 212 may be supplied to a plurality of switch arrays included in the second channel circuit 22 through the output lines OL of the second gamma reference voltage output circuit 200.

Meanwhile, the second gamma reference voltage output circuit 200 may further include an opposite-sided gamma buffer circuit 222 including M opposite-sided gamma buffers having input ends that are distributedly connected to the first opposite-sided resistor array 212*e*.

If the second gamma reference voltage output circuit 200 further includes the opposite-sided gamma buffer circuit 222, the output side of the opposite-sided gamma buffer circuit 222 may not be electrically connected to the opposite-sided gamma reference voltage generating circuit 232, or power may not be supplied to the opposite-sided gamma buffer circuit 222, that is, the M opposite-sided gamma buffers.

This is due to the fact that the opposite-sided gamma reference voltage generating circuit 232 uses M one-sided buffering voltages input through the buffering voltage relay circuit 310, instead of using M opposite-sided buffering voltages buffered in the opposite-sided gamma buffer circuit 222, when generating the second opposite-sided gamma reference voltage to the $(N-1)^{th}$ opposite-sided gamma reference voltage.

In the first embodiment, for the following reason, the opposite end of the first one-sided line 112*b* and the opposite end of the first opposite-sided line 212*b* are electrically isolated from each other, the opposite end of the second one-sided line 112*d* and the opposite end of the second opposite-sided line 212*d* are electrically isolated from each other, and the opposite-sided gamma reference voltage generating circuit 232 generates the second opposite-sided gamma reference voltage to the $(N-1)^{th}$ opposite-sided gamma reference voltage using the M one-sided buffering voltages.

First, the M one-sided gamma buffers constituting the one-sided gamma buffer circuit 122 and the M opposite-sided gamma buffers constituting the opposite-sided gamma buffer circuit 222 may have different manufacturing tolerances even if they are the same product. This may generate a deviation between the one-sided buffering voltage output from the one-sided gamma buffer and the opposite-sided buffering voltage output from the opposite-sided gamma buffer, thereby causing a deviation between the one-sided gamma reference voltage and the opposite-sided gamma reference voltage.

In the first embodiment, in order to eliminate the above deviation in the gamma reference voltage, the M one-sided buffering voltages output from the one-sided gamma buffer circuit 122 are also used in the opposite-sided gamma reference voltage generating circuit 232 to generate the opposite-sided gamma reference voltage, thereby eliminating the deviation in the gamma reference voltage between the two sides, which is caused by the deviation in the buffering voltage between the two sides.

Meanwhile, since the first one-sided gamma reference voltage and the $N^{th}$ one-sided gamma reference voltage, which are output from the one-sided power input circuit 112, a signal having the first one-sided gamma reference voltage, and a signal having the $N^{th}$ one-sided gamma reference voltage are also used as power to generate the M one-sided division voltages and the second one-sided gamma reference voltage to the $(N-1)^{th}$ one-sided gamma reference voltage, they have very large current values compared to the M one-sided buffering voltages output from the one-sided gamma buffer circuit 122.

Here, the buffering voltage relay circuit 310, which will be described later, may include a plurality of lines, and each of the lines may have internal resistance.

Therefore, in the case where the buffering voltage relay circuit 310 transmits the first one-sided gamma reference voltage to the opposite-sided gamma reference voltage generating circuit 232 in order for the second gamma reference voltage output circuit 200 to use the first one-sided gamma reference voltage in common, the amount of change in the voltage increases due to the very large current value and internal resistance of the line compared to the M one-sided buffering voltages.

Accordingly, the deviation between the first one-sided gamma reference voltage used in the opposite-sided gamma reference voltage generating circuit 232 and the first one-sided gamma reference voltage used in the one-sided gamma reference voltage generating circuit 132 may also increase. Therefore, the opposite end of the first one-sided line 112*b* and the opposite end of the first opposite-sided line 212*b* are electrically isolated from each other, the opposite end of the second one-sided line 112*d* and the opposite end of the second opposite-sided line 212*d* are electrically isolated from each other, and the opposite-sided gamma reference voltage generating circuit 232 uses the first opposite-sided gamma reference voltage.

Here, the value of the first opposite-sided gamma reference voltage and the value of the first one-sided gamma reference voltage must match each other, and the value of the $N^{th}$ opposite-sided gamma reference voltage and the value of the $N^{th}$ one-sided gamma reference voltage must also match each other.

To this end, in the first embodiment, the first input voltage Vin1 input to the first one-sided input buffer 112*a* of the first gamma reference voltage output circuit 100 and the third input voltage Vin3 input to the first opposite-sided input buffer 212*a* of the second gamma reference voltage output circuit 200 may be adjusted to match each other so that the value of the first opposite-sided gamma reference voltage and the value of the first one-sided gamma reference voltage match each other.

Likewise, the second input voltage Vin2 input to the second one-sided input buffer 112*c* of the first gamma reference voltage output circuit 100 and the fourth input voltage Vin4 input to the second opposite-sided input buffer 212*c* of the second gamma reference voltage output circuit 200 may be adjusted to match each other so that the value of the $N^{th}$ opposite-sided gamma reference voltage and the value of the $N^{th}$ one-sided gamma reference voltage match each other.

In addition, in the first embodiment, the output of the first one-sided input buffer 112*a* and the first opposite-sided input buffer 212*a* may be adjusted so that the value of the first opposite-sided gamma reference voltage matches the value of the first one-sided gamma reference voltage, and the output of the second one-sided input buffer 112*c* and the second opposite-sided input buffer 212*c* may be adjusted so that the value of the $N^{th}$ opposite-sided gamma reference voltage matches the value of the $N^{th}$ one-sided gamma reference voltage.

Here, control for matching the first input voltage with the third input voltage and control for matching the second input voltage with the fourth input voltage may be performed by the timing control device 4 or a separate power controller (not shown).

Similarly, control for adjusting the output of the first one-sided input buffer 112*a* and the first opposite-sided input buffer 212*a* and control for adjusting the output of the second one-sided input buffer 112*c* and the second opposite-sided input buffer 212*c* may also be performed by the timing control device 4 or a separate power controller (not shown).

Meanwhile, in the first embodiment, the buffering voltage relay circuit 310 that transmits only M one-sided buffering voltages to the opposite-sided gamma reference voltage generating circuit 232, that is, the buffering voltage relay circuit 310, which has one end connected to the output side of the one-sided gamma buffer circuit 122 and transmits M one-sided buffering voltages to the opposite-sided gamma reference voltage generating circuit 232 connected to the opposite end thereof, may include, as shown in FIG. 2, M one-sided inner lines 312*a* to 312*g* having one end connected to an output side of the M one-sided gamma buffers and the opposite end at which a one-sided connection pad is formed, M opposite-sided inner lines 314*a* to 314*g* having one end connected to an input side of the opposite-sided gamma reference voltage generating circuit and the opposite end at which an opposite-sided connection pad is formed, and M connection lines 316*a* to 316*g* having one end connected to each of the M one-sided connection pads and the opposite end connected to each of the M opposite-sided connection pads.

Figure 3:
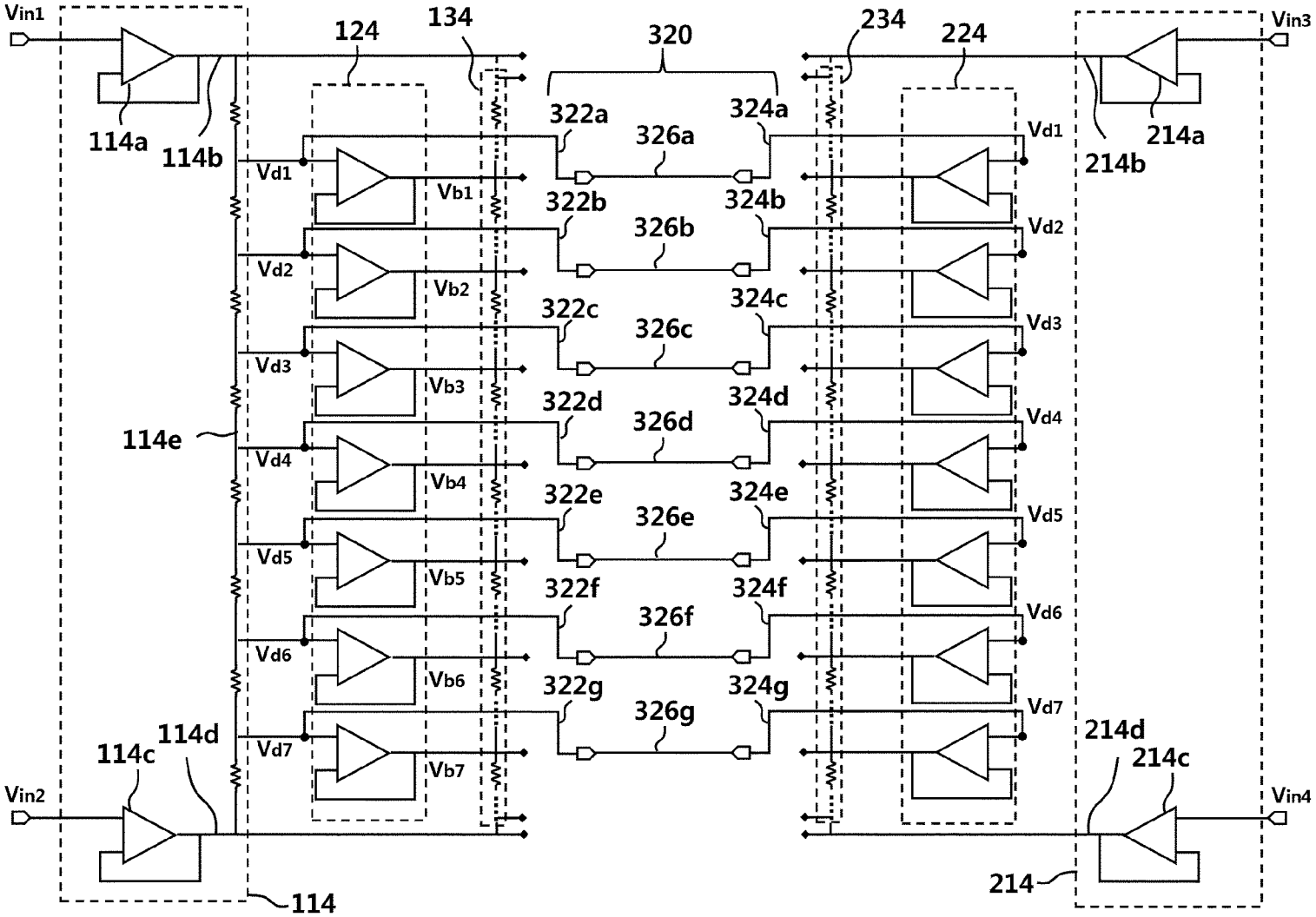
FIG. 3 is a block diagram of a gamma reference voltage output circuit according to a second embodiment.

FIG. 3 is a block diagram of a gamma reference voltage output circuit according to a second embodiment.

Referring to FIG. 3, a gamma reference voltage output circuit according to a second embodiment may include a first gamma reference voltage output circuit 100 included in the first driving chip 10, a second gamma reference voltage output circuit 200 included in the second driving chip 20, and a division voltage relay circuit 320 for electrically connecting the first gamma reference voltage output circuit 100 with the second gamma reference voltage output circuit 200.

In the second embodiment, the first gamma reference voltage output circuit 100 may include a one-sided power input circuit 114, a one-sided gamma buffer circuit 124, and a one-sided gamma reference voltage generating circuit 134.

The one-sided power input circuit 114 may output a first one-sided gamma reference voltage, an $N^{th}$ one-sided gamma reference voltage, and M one-sided division voltages.

The one-sided power input circuit 114 may include a first one-sided input buffer 114*a* for receiving a first input voltage Vin1 and outputting a first one-sided gamma reference voltage V1, a first one-sided line 114*b* having one end connected to the output end of the first one-sided input buffer 114*a*, a second one-sided input buffer 114*c* for receiving a second input voltage Vin2 and outputting an $N^{th}$ one-sided gamma reference voltage (e.g., V1024), a second one-sided line 114*d* connected to the output end of the second one-sided input buffer 114*c*, and a first one-sided resistor array 114*e* for receiving the first one-sided gamma reference voltage V1 from the first one-sided line 114*b* and generating M one-sided division voltages (e.g., Vd1 to Vd7).

The one-sided gamma buffer circuit 124 may receive M one-sided division voltages generated by the first one-sided resistor array 114*e*, and may buffer the M one-sided division voltages, thereby outputting M one-sided buffering voltages. The one-sided gamma buffer circuit 124 may include M one-sided gamma buffers.

The one-sided gamma reference voltage generating circuit 134 may include a plurality of resistors connected to each other in series, and may separate the first one-sided gamma reference voltage and the M one-sided buffering voltages using the plurality of resistors, thereby generating a second one-sided gamma reference voltage to an $(N-1)^{th}$ one-sided gamma reference voltage.

The second one-sided gamma reference voltage to the $(N-1)^{th}$ one-sided gamma reference voltage generated by the one-sided gamma reference voltage generating circuit 134 and the first one-sided gamma reference voltage and the $N^{th}$ one-sided gamma reference voltage output from the one-sided power input circuit 114 may be supplied to a plurality of switch arrays included in the first channel circuit 12 through the output lines OL of the first gamma reference voltage output circuit 100.

The second gamma reference voltage output circuit 200 may include an opposite-sided power input circuit 214, an opposite-sided gamma buffer circuit 224, and an opposite-sided gamma reference voltage generating circuit 234.

The opposite-sided power input circuit 214 may output a first opposite-sided gamma reference voltage and an $N^{th}$ opposite-sided gamma reference voltage in the state of being electrically isolated from the one-sided power input circuit 114. Here, the first opposite-sided gamma reference voltage may correspond to the first one-sided gamma reference voltage, and the $N^{th}$ opposite-sided gamma reference voltage may correspond to the $N^{th}$ one-sided gamma reference voltage.

The opposite-sided power input circuit 214 may include a first opposite-sided input buffer 214*a* for receiving a third input voltage Vin3 and outputting a first opposite-sided gamma reference voltage V1', a first opposite-sided line 214*b* having one end connected to the output end of the first opposite-sided input buffer 214*a*, a second opposite-sided input buffer 214*c* for receiving a fourth input voltage Vin4 and outputting an $N^{th}$ opposite-sided gamma reference voltage (e.g., V1024'), and a second opposite-sided line 214*d* connected to the output end of the second opposite-sided input buffer 214*c*. Here, the opposite end of the first one-sided line 114*b* and the opposite end of the first opposite-sided line 214*b* may be electrically isolated from each other, and the opposite end of the second one-sided line 114*d* and the opposite end of the second opposite-sided line 214*d* may also be electrically isolated from each other.

The opposite-sided gamma buffer circuit 224 may receive M one-sided division voltages through the input side connected to the opposite end of the division voltage relay circuit 320, and may buffer the M one-sided division voltages, thereby outputting M opposite-sided buffering voltages.

The opposite-sided gamma reference voltage generating circuit 234 may include a number of resistors connected to each other in series, and may separate the first opposite-sided gamma reference voltage and the M opposite-sided buffering voltages output from the opposite-sided gamma buffer circuit 224 using the resistors, thereby generating a second opposite-sided gamma reference voltage to an $(N-1)^{th}$ opposite-sided gamma reference voltage.

Here, one end of the opposite-sided gamma reference voltage generating circuit 234 may be connected to the first opposite-sided line 214*b*, and the opposite end thereof may be connected to the second opposite-sided line 214*d*.

In addition, the opposite-sided buffering voltages output from the opposite-sided gamma buffer circuit 224 may be input to nodes formed in some of the multiple resistors constituting the opposite-sided gamma reference voltage generating circuit 232.

The resistance value of each of the plurality of resistors constituting the opposite-sided gamma reference voltage generating circuit 234 may be the same as the resistance value of each of the plurality of resistors constituting the one-sided gamma reference voltage generating circuit 134.

The second opposite-sided gamma reference voltage to the $(N-1)^{th}$ opposite-sided gamma reference voltage generated by the opposite-sided gamma reference voltage generating circuit 234 and the first opposite-sided gamma reference voltage and the $N^{th}$ opposite-sided gamma reference voltage output from the opposite-sided power input circuit 214 may be supplied to a plurality of switch arrays included in the second channel circuit 22 through the output lines OL of the second gamma reference voltage output circuit 200.

In the second embodiment, the reason why the opposite end of the first one-sided line 114*b* and the opposite end of the first opposite-sided line 214*b* are electrically isolated from each other and the opposite end of the second one-sided line 114*d* and the opposite end of the second opposite-sided line 214*d* are electrically isolated from each other is the same as the reason described in the first embodiment.

Meanwhile, in the second embodiment, the reason why the opposite-sided gamma buffer circuit 224 outputs M opposite-sided buffering voltages using M one-sided division voltages is as follows.

First of all, in the case where the opposite-sided power input circuit 214 includes a resistor array generating the opposite-sided division voltages, the resistors of the first one-sided resistor array 114*e* included in the one-sided power input circuit 114 and the resistors included in the resistor array of the opposite-sided power input circuit 214 may have different manufacturing tolerances, and this may generate a deviation in the division voltage between the two sides, thereby causing a deviation in the gamma reference voltage between both side.

In the second embodiment, in order to eliminate the deviation in the gamma reference voltage, the M one-sided division voltages generated by the first one-sided resistor array 114*e* are also used in the opposite-sided gamma buffer circuit 224 to generate the opposite-sided buffering voltages, thereby eliminating the deviation in the gamma reference voltage between the two sides, which is caused by the deviation in the division voltage between the two sides.

Meanwhile, in the second embodiment, the value of the first opposite-sided gamma reference voltage and the value of the first one-sided gamma reference voltage must match each other, and the value of the $N^{th}$ opposite-sided gamma reference voltage and the value of the $N^{th}$ one-sided gamma reference voltage must also match each other.

To this end, in the second embodiment, the first input voltage Vin1 input to the first one-sided input buffer 114*a* of the first gamma reference voltage output circuit 100 and the third input voltage Vin3 input to the first opposite-sided input buffer 214*a* of the second gamma reference voltage output circuit 200 may be adjusted to match each other, so that the value of the first opposite-sided gamma reference voltage and the value of the first one-sided gamma reference voltage match each other.

Likewise, the second input voltage Vin2 input to the second one-sided input buffer 114*c* of the first gamma reference voltage output circuit 100 and the fourth input voltage Vin4 input to the second opposite-sided input buffer 214*c* of the second gamma reference voltage output circuit 200 may be adjusted to match each other so that the value of the $N^{th}$ opposite-sided gamma reference voltage and the value of the $N^{th}$ one-sided gamma reference voltage match each other.

In addition, in the second embodiment, the output of the first one-sided input buffer 114*a* and the first opposite-sided input buffer 214*a* may be adjusted so that the value of the first opposite-sided gamma reference voltage matches the value of the first one-sided gamma reference voltage, and the output of the second one-sided input buffer 114*c* and the second opposite-sided input buffer 214*c* may be adjusted so that the value of the $N^{th}$ opposite-sided gamma reference voltage matches the value of the $N^{th}$ one-sided gamma reference voltage.

Here, control for matching the first input voltage with the third input voltage and control for matching the second input voltage with the fourth input voltage may be performed by the timing control device 4 or a separate power controller (not shown).

Similarly, control for adjusting the output of the first one-sided input buffer 114*a* and the first opposite-sided input buffer 214*a* and control for adjusting the output of the second one-sided input buffer 114*c* and the second opposite-sided input buffer 214*c* may also be performed by the timing control device 4 or a separate power controller (not shown).

Meanwhile, in the second embodiment, the division voltage relay circuit 320 that transmits only M one-sided division voltages to the opposite-sided gamma buffer circuit 224, that is, the division voltage relay circuit 320, which has one end connected to the input side of the one-sided gamma buffer circuit 124 and transmits M one-sided division voltages to the input side of the opposite-sided gamma buffer circuit 224 connected to the opposite end thereof, may include, as shown in FIG. 3, M one-sided inner lines 322*a* to 322*g* having one end connected to an input side of the M one-sided gamma buffers and the opposite end at which a one-sided connection pad is formed, M opposite-sided inner lines 324*a* to 324*g* having one end connected to an input side of the opposite-sided gamma buffer circuit 224 and the opposite end at which the opposite-sided connection pad is formed, and M connection lines 326*a* to 326*g* having one end connected to each of the M one-sided connection pads and the opposite end connected to each of the M opposite-sided connection pads.

Figure 4:
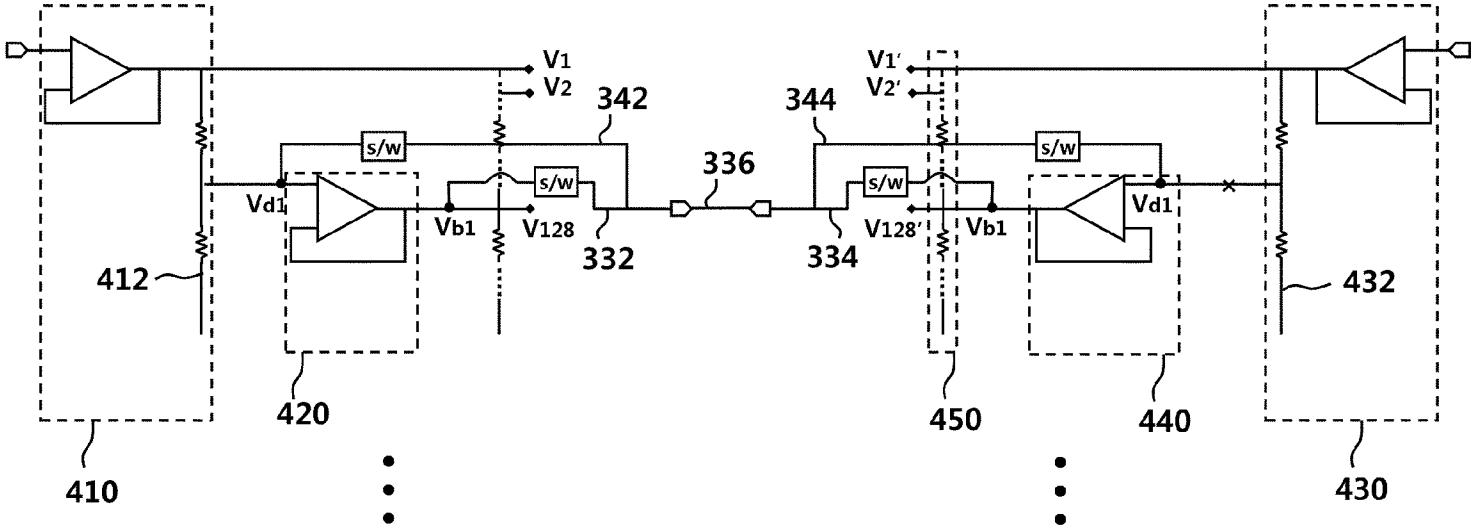
FIG. 4 is a block diagram of a gamma reference voltage output circuit according to a third embodiment.

FIG. 4 is a block diagram of a gamma reference voltage output circuit according to a third embodiment.

A gamma reference voltage output circuit according to a third embodiment may selectively use a one-sided buffering voltage and a one-sided division voltage in the second gamma reference voltage output circuit 200 by configuring both buffering voltage relay circuits 332, 336, and 334 including switches s/w and division voltage relay circuits 342, 344, and 336 including switches s/w as shown in FIG. 4.

In other words, if any one of the switch of the division voltage relay circuit 342, 344, or 336 and the switch of the buffering voltage relay circuit 332, 336, or 334 is turned on, the other one may remain turned off.

Specifically, in FIG. 4, if the switches of the division voltage relay circuits 342, 344, and 336 are turned on, and if the switches of the buffering voltage relay circuits 332, 336, and 334 are turned off, the opposite-sided gamma buffer circuit 440 may receive M one-sided division voltages from the division voltage relay circuits 342, 344, and 336, and may output M opposite-sided buffering voltages, and the opposite-sided gamma reference voltage generating circuit may generate a second opposite-sided gamma reference voltage to an $(N-1)^{th}$ opposite-sided gamma reference voltage using the M opposite-sided buffering voltages and the first opposite-sided gamma reference voltage V1'.

On the other hand, if the switches of the buffering voltage relay circuits 332, 336, and 334 are turned on, and if the switches of the division voltage relay circuits 342, 344, and 336 are turned off, the opposite-sided gamma reference voltage generating circuit 450 may receive M one-sided buffering voltages from the buffering voltage relay circuits 332, 336, and 334, and may generate a second opposite-sided gamma reference voltage to an $(N-1)^{th}$ opposite-sided gamma reference voltage using the M one-sided buffering voltages and the first opposite-sided gamma reference voltage V F.

In the third embodiment having the above configuration, an opposite-sided resistor array 432 included in an opposite-sided power input circuit 430 may be electrically isolated from an opposite-sided gamma buffer circuit 440. Here, a one-sided switch may be disposed between a one-sided resistor array 412 included in a one-sided power input circuit 410 and a one-sided gamma buffer circuit 420, and an opposite-sided switch may be disposed between the opposite-sided resistor array 432 included in the opposite-sided power input circuit 430 and the opposite-sided gamma buffer circuit 440. In addition, when the data driving device 2 is operating, the one-sided switch may always be turned on, and the opposite-sided switch may always be turned off, so that the opposite-sided resistor array 432 and the opposite-sided gamma buffer circuit 440 may be electrically isolated from each other.

In the third embodiment, control for turning on/off the switch included in each of the buffering voltage relay circuits 332, 336, and 334 and the division voltage relay circuits 342, 344, and 336 may be performed by the timing control device 4 or a separate controller (not shown).

In the third embodiment, the buffering voltage relay circuits 332, 336, and 334 and the division voltage relay circuits 342, 344, and 336 may share the connection line 336.

Figure 5:
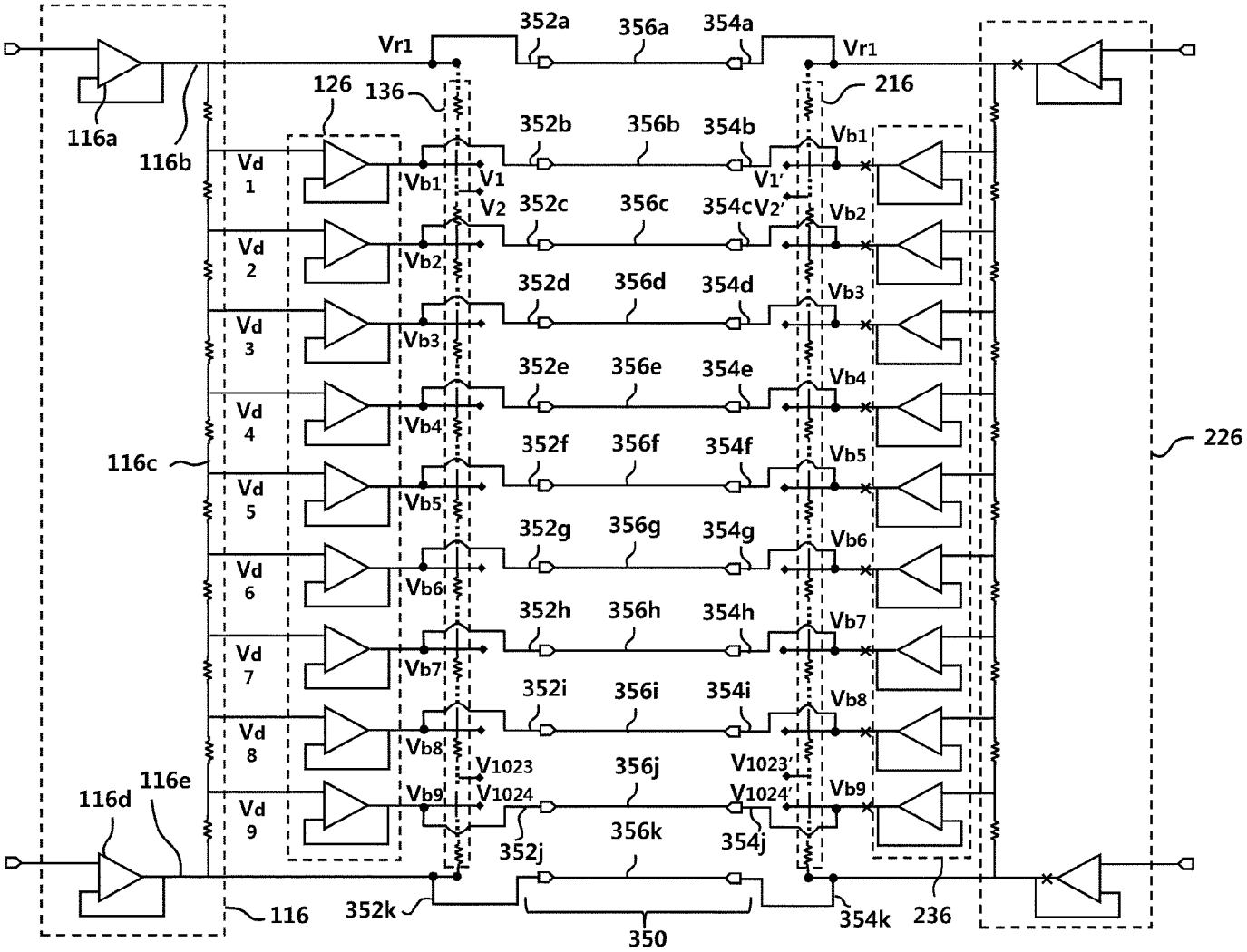
FIG. 5 is a block diagram of a gamma reference voltage output circuit according to a fourth embodiment.

FIG. 5 is a block diagram of a gamma reference voltage output circuit according to a fourth embodiment.

Referring to FIG. 5, a gamma reference voltage output circuit according to a fourth embodiment may include a first gamma reference voltage output circuit 100 included in the first driving chip 10, a second gamma reference voltage output circuit 200 included in the second driving chip 20, and a one-sided voltage relay circuit 350 for electrically connecting the first gamma reference voltage output circuit 100 with the second gamma reference voltage output circuit 200.

In the fourth embodiment, the gamma reference voltage is not generated in the portions of a one-sided gamma reference voltage generating circuit 136 and an opposite-sided gamma reference voltage generating circuit 236, which are adjacent to the power line and may cause a great deviation in the gamma reference voltage between the two sides, and two gamma buffers (M+2) are further added to the existing (M) gamma buffers, so that the gamma reference voltages are generated from the portion to which a buffering voltage is input from the M+2 gamma buffers, thereby eliminating the deviation in the gamma reference voltage between the two sides.

Specifically, in the fourth embodiment, the first gamma reference voltage output circuit 100 may include a one-sided power input circuit 116, a one-sided gamma buffer circuit 126, and a one-sided gamma reference voltage generating circuit 136.

The one-sided power input circuit 116 may output a first one-sided reference voltage, an $N^{th}$ one-sided reference voltage, and M+2 one-sided division voltages.

The one-sided power input circuit 116 may include a first one-sided input buffer 116*a* for receiving a first input voltage Vin1 and outputting a first one-sided reference voltage Vr1, a first one-sided line 116*b* having one end connected to the output end of the first one-sided input buffer 116*a*, and a first one-sided resistor array 116*c* for receiving the first one-sided reference voltage Vr1 from the first one-sided line and generating M+2 one-sided division voltages Vd1 to Vd9.

The one-sided power input circuit 116 may further include a second one-sided input buffer 116*d* for receiving a second input voltage Vin2 and outputting a second one-sided reference voltage, and a second one-sided line 116*e* connected to the output end of the second one-sided input buffer 116*d*.

In the fourth embodiment, although a description is made based on the case in which the first one-sided reference voltage Vr1 is input to the first one-sided resistor array 116*e* for convenience of explanation, the first one-sided resistor array 116*e* may receive the second one-sided reference voltage from the second one-sided line 116*e*, and may generate M+2 one-sided division voltages in the practical application of an embodiment.

The one-sided gamma buffer circuit 126 may receive M+2 one-sided division voltages generated by the first one-sided resistor array 116*e*, may buffer the same, and may output M+2 one-sided buffering voltages. The one-sided gamma buffer circuit 126 may include M+2 one-sided gamma buffers.

The one-sided gamma reference voltage generating circuit 136 may include a plurality of resistors connected to each other in series, and may separate the first one-sided reference voltage from the M+2 one-sided buffering voltages using the resistors, thereby generating a first one-sided gamma reference voltage to an $N^{th}$ one-sided gamma reference voltage. That is, the one-sided gamma reference voltage generating circuit 136 may generate a first one-sided gamma reference voltage V1 to an $N^{th}$ one-sided gamma reference voltage V1024 using the first one-sided reference voltage and the M+2 one-sided buffering voltages.

Here, one end of the one-sided gamma reference voltage generating circuit 136 may be connected to a first one-sided line 116*b*, and the opposite end thereof may be connected to the second one-sided line 116*e*. In addition, the portion between points connected to the first one-sided line 116*b* at the nodes to which the first one-sided buffering voltage is input and the portion between points connected to the second one-sided line 116*e* at the nodes to which the M+2 one-sided buffering voltages are input may not be connected to the output lines OL of the first gamma reference voltage output circuit 100.

The first one-sided gamma reference voltage to the $N^{th}$ one-sided gamma reference voltage generated by the one-sided gamma reference voltage generating circuit 136 may be supplied to a plurality of switch arrays included in the first channel circuit 12 through the output lines OL of the first gamma reference voltage output circuit 100.

The second gamma reference voltage output circuit 200 may include an opposite-sided gamma reference voltage generating circuit 216.

The opposite-sided gamma reference voltage generating circuit 216 may be connected to the opposite end of a one-sided voltage relay circuit 350, which will be described later, to receive a first one-sided reference voltage and M+2 one-sided buffering voltages, and may generate a first opposite-sided gamma reference voltage V1' to an $N^{th}$ opposite-sided gamma reference voltage V1024' using the M+2 one-sided buffering voltages and the first one-sided reference voltage.

The second gamma reference voltage output circuit 200 may further include an opposite-sided power input circuit 226 and an opposite-sided gamma buffer circuit 236 including M+2 opposite-sided gamma buffers. The opposite-sided power input circuit 226 and the opposite-sided gamma buffer circuit 236 may be continuously maintained in a state of electrical isolation from the opposite-sided gamma reference voltage generating circuit 216.

Meanwhile, the first opposite-sided gamma reference voltage to the $N^{th}$ opposite-sided gamma reference voltage generated by the opposite-sided gamma reference voltage generating circuit 216 may be supplied to a plurality of switch arrays included in a second channel circuit 22 through the output lines OL of the second gamma reference voltage output circuit 200.

In the fourth embodiment, the one-sided voltage relay circuit 350 for transmitting the M+2 one-sided buffering voltages and the first one-sided reference voltage Vr1 to the opposite-sided gamma reference voltage generating circuit 216, that is, the one-sided voltage relay circuit 350, which has one end connected to the output side of the one-sided power input circuit 116 and the output side of the one-sided gamma buffer circuit 126, respectively, and transmits the first one-sided reference voltage Vr1 and the M+2 one-sided buffering voltage to the opposite-sided gamma reference voltage generating circuit 216 connected to the opposite end thereof, may include, as shown in FIG. 5, M+3 one-sided inner lines 352*a* to 352*j* having one end connected to the first one-sided line 116*b* and an output side of each of the M+2 one-sided gamma buffers and the opposite end at which a one-sided connection pad is provided, M+3 opposite-sided inner lines 354*a* to 354*j* having one end connected to an input side of the opposite-sided gamma reference voltage generating circuit 216 and the opposite end at which an opposite-sided connection pad is provided, and M+3 connection lines 356*a* to 356*j* having one end connected to each of the M+3 one-sided connection pads and the opposite end connected to each of the M+3 opposite-sided connection pads. Here, the one-sided voltage relay circuit 350 may further include a one-sided inner line 352*k*, an opposite-sided inner line 354*k*, and a connection line 356*k*.

What is claimed is:

1. A gamma reference voltage output circuit of a display device, the gamma reference voltage output circuit comprising:

a first gamma reference voltage output circuit comprising a one-sided gamma buffer circuit configured to receive M (M is a natural number) one-sided division voltages and to output M one-sided buffering voltages, and a one-sided gamma reference voltage generating circuit configured to generate a second one-sided gamma reference voltage to an $(N-1)^{th}$ (N is a natural number greater than M) one-sided gamma reference voltage using the M one-sided buffering voltages and the first one-sided gamma reference voltage;

a buffering voltage relay circuit having one end connected to an output side of the one-sided gamma buffer circuit and configured to transmit the M one-sided buffering voltages to an opposite end thereof; and a second gamma reference voltage output circuit comprising an opposite-sided gamma reference voltage generating circuit connected to the opposite end of the buffering voltage relay circuit and configured to receive the M one-sided buffering voltages and to generate a second opposite-sided gamma reference voltage to an $(N-1)^{th}$ opposite-sided gamma reference voltage using the M one-sided buffering voltages and a first opposite-sided gamma reference voltage.

2. The gamma reference voltage output circuit of claim 1, wherein the first gamma reference voltage output circuit further comprises a one-sided power input circuit configured to output the first one-sided gamma reference voltage, an $N^{th}$ one-sided gamma reference voltage, and the M one-sided division voltages, and the second gamma reference voltage output circuit further comprises an opposite-sided power input circuit configured to output a first opposite-sided gamma reference voltage matching the first one-sided gamma reference voltage and an $N^{th}$ opposite-sided gamma reference voltage matching the $N^{th}$ one-sided gamma reference voltage in a state of being electrically isolated from the one-sided power input circuit.

3. The gamma reference voltage output circuit of claim 2, wherein the one-sided power input circuit comprises:

a first one-sided input buffer configured to receive a first input voltage and to output the first one-sided gamma reference voltage;

a first one-sided line having one end connected to an output end of the first one-sided input buffer;

a second one-sided input buffer configured to receive a second input voltage and to output the $N^{th}$ one-sided gamma reference voltage;

a second one-sided line having one end connected to an output end of the second one-sided input buffer; and a first one-sided resistor array configured to receive the first one-sided gamma reference voltage from the first one-sided line and to generate the M one-sided division voltages.

4. The gamma reference voltage output circuit of claim 3, wherein the opposite-sided power input circuit comprises:

a first opposite-sided input buffer configured to receive a third input voltage and to output the first opposite-sided gamma reference voltage;

a first opposite-sided line having one end connected to an output end of the first opposite-sided input buffer;

a second opposite-sided input buffer configured to receive a fourth input voltage and to output the $N^{th}$ opposite-sided gamma reference voltage; and a second opposite-sided line having one end connected to an output end of the second opposite-sided input buffer.

5. The gamma reference voltage output circuit of claim 4, wherein an opposite end of the first one-sided line and an opposite end of the first opposite-sided line are electrically isolated from each other, and an opposite end of the second one-sided line and an opposite end of the second opposite-sided line are also electrically isolated from each other.

6. The gamma reference voltage output circuit of claim 5, wherein the first input voltage and the third input voltage are adjusted such that the first opposite-sided gamma reference voltage and the first one-sided gamma reference voltage match each other, and the second input voltage and the fourth input voltage are adjusted such that the $N^{th}$ opposite-sided gamma reference voltage and the $N^{th}$ one-sided gamma reference voltage match each other.

7. A gamma reference voltage output circuit of a display device, the gamma reference voltage output circuit comprising:

a first gamma reference voltage output circuit comprising a one-sided gamma buffer circuit configured to receive M (M is a natural number) one-sided division voltages, to buffer the M one-sided division voltages, and to output M one-sided buffering voltages and a one-sided gamma reference voltage generating circuit configured to generate a second one-sided gamma reference voltage to an $(N-1)^{th}$ (N is a natural number greater than M) one-sided gamma reference voltage using the M one-sided buffering voltages and a first one-sided gamma reference voltage;

a division voltage relay circuit having one end connected to an input side of the one-sided gamma buffer circuit and configured to transmit the M one-sided division voltages to an opposite end thereof; and a second gamma reference voltage output circuit comprising an opposite-sided gamma buffer circuit having an input side connected to the opposite end of the division voltage relay circuit and configured to receive the M one-sided division voltages, to buffer the M one-sided division voltages, and to output M opposite-sided buffering voltages and an opposite-sided gamma reference voltage generating circuit configured to generate a second opposite-sided gamma reference voltage to an $(N-1)^{th}$ opposite-sided gamma reference voltage using the M opposite-sided buffering voltages and the first opposite-sided gamma reference voltage.

8. The gamma reference voltage output circuit of claim 7, wherein the first gamma reference voltage output circuit further comprises a one-sided power input circuit configured to output the first one-sided gamma reference voltage, an $N^{th}$ one-sided gamma reference voltage, and the M one-sided division voltages, and the second gamma reference voltage output circuit further comprises an opposite-sided power input circuit configured to output a first opposite-sided gamma reference voltage corresponding to the first one-sided gamma reference voltage and an $N^{th}$ opposite-sided gamma reference voltage corresponding to the $N^{th}$ one-sided gamma reference voltage in a state of being electrically isolated from the one-sided power input circuit.

9. The gamma reference voltage output circuit of claim 7, further comprising a buffering voltage relay circuit having one end connected to an output side of the one-sided gamma buffer circuit and the opposite end connected to an opposite-sided gamma reference voltage generating circuit and configured to transmit the M one-sided buffering voltages to the opposite-sided gamma reference voltage generating circuit.

10. The gamma reference voltage output circuit of claim 9, wherein each of the division voltage relay circuit and the buffering voltage relay circuit comprises a switch, and if any one of a switch of the division voltage relay circuit and a switch of the buffering voltage relay circuit is turned on, a remaining one thereof remains turned off.

11. The gamma reference voltage output circuit of claim 10, wherein if the switch of the division voltage relay circuit is turned on and the switch of the buffering voltage relay circuit is turned off, the opposite-sided gamma buffer circuit receives the M one-sided division voltages from the division voltage relay circuit and outputs them as the M opposite-sided buffering voltages, and the opposite-sided gamma reference voltage generating circuit generates the second opposite-sided gamma reference voltage to the $(N-1)^{th}$ opposite-sided gamma reference voltage using the M opposite-sided buffering voltages and the first opposite-sided gamma reference voltage.

12. The gamma reference voltage output circuit of claim 10, wherein if the switch of the buffering voltage relay circuit is turned on and the switch of the division voltage relay circuit is turned off, the opposite-sided gamma reference voltage generating circuit receives the M one-sided buffering voltages from the buffering voltage relay circuit and generates the second opposite-sided gamma reference voltage to the $(N-1)^{th}$ opposite-sided gamma reference voltage using the M one-sided buffering voltages and the first opposite-sided gamma reference voltage.

13. A gamma reference voltage output circuit of a display device, the gamma reference voltage output circuit comprising:

a first gamma reference voltage output circuit comprising a one-sided power input circuit configured to output a first one-sided reference voltage and (M+2) (M is a natural number) one-sided division voltages, a one-sided gamma buffer circuit configured to receive the (M+2) one-sided division voltages and to output (M+2) one-sided buffering voltages, and a one-sided gamma reference voltage generating circuit configured to generate a first one-sided gamma reference voltage to an $N^{th}$ (N is a natural number greater than M) one-sided gamma reference voltage using the (M+2) one-sided buffering voltages and the first one-sided reference voltage;

a one-sided voltage relay circuit having one end connected respectively to an output side of the one-sided power input circuit and to an output side of the one-sided gamma buffer circuit, and configured to transmit the first one-sided reference voltage and the (M+2) one-sided buffering voltages to an opposite end thereof; and a second gamma reference voltage output circuit comprising an opposite-sided gamma reference voltage generating circuit connected to the opposite end of the one-sided voltage relay circuit and configured to receive the first one-sided reference voltage and the (M+2) one-sided buffering voltages and to generate a first opposite-sided gamma reference voltage to an $N^{th}$ opposite-sided gamma reference voltage using the (M+2) one-sided buffering voltages and the first one-sided reference voltage.

14. The gamma reference voltage output circuit of claim 13, wherein the one-sided power input circuit comprises:

a first one-sided input buffer configured to receive a first voltage and to output the first one-sided reference voltage;

a first one-sided line having one end connected to an output end of the first one-sided input buffer; and a first one-sided resistor array configured to receive the first one-sided reference voltage from the first one-sided line and to generate the (M+2) one-sided division voltages.

15. The gamma reference voltage output circuit of claim 14, wherein the one-sided gamma buffer circuit comprises (M+2) one-sided gamma buffers, and the one-sided voltage relay circuit comprises:

(M+3) one-sided inner lines having one ends connected respectively to the first one-sided line and to output sides of the (M+2) one-sided gamma buffers, and the opposite ends at which one-sided connection pads are provided;

(M+3) opposite-sided inner lines having one ends connected to input sides of the opposite-sided gamma reference voltage generating circuit and the opposite ends at which opposite-sided connection pads are provided; and (M+3) connection lines having one end connected to each of the (M+3) one-sided connection pads and the opposite end connected to each of the (M+3) opposite-sided connection pads.

* * * * *